US006295837B1

(12) United States Patent
Den et al.

(10) Patent No.: US 6,295,837 B1
(45) Date of Patent: Oct. 2, 2001

(54) APPARATUS FOR AIR SEPARATION

(75) Inventors: Ryo Den; Shinji Tomita, both of Hyogo-ken (JP)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/577,049

(22) Filed: May 24, 2000

(30) Foreign Application Priority Data

May 26, 1999 (JP) ..... 11-145962

(51) Int. Cl.[7] ..... F25J 1/00
(52) U.S. Cl. ..... 62/643; 62/434; 62/912
(58) Field of Search ..... 62/643, 434, 912

(56) References Cited

U.S. PATENT DOCUMENTS

| | | | |
|---|---|---|---|
| 2,729,953 | 1/1956 | Schilling . | |
| 3,339,370 | 9/1967 | Streich et al. . | |
| 4,054,433 * | 10/1977 | Buffiere et al. | 62/912 |
| 4,345,925 | 8/1982 | Cheung . | |
| 5,220,798 * | 6/1993 | Nagamura et al. | 62/912 |
| 5,475,980 | 12/1995 | Grenier et al. . | |

FOREIGN PATENT DOCUMENTS

| | | |
|---|---|---|
| 804944 | 11/1958 | (GB) . |
| 46-16081 | 5/1971 | (JP) . |
| 49-45054 | 12/1974 | (JP) . |
| 52-41224 | 10/1977 | (JP) . |

OTHER PUBLICATIONS

English abstract of SU 488 967, XP–002147583.
English abstract of BE 803171.
English abstract of JP 46–16081.
English abstract of JP 52 41224.

* cited by examiner

*Primary Examiner*—Ronald Capossela
(74) *Attorney, Agent, or Firm*—Burns, Doane, Swecker & Mathis, L.L.P.

(57) ABSTRACT

The object of the present invention is to separate air at low power cost to produce high-pressure nitrogen gas and oxygen gas by utilizing cold of liquefied natural gas. Feed air is pre-purified and then introduced into a cryogenic separation unit, so that oxygen gas and nitrogen gas are separated. The nitrogen gas separated in the cryogenic separation unit is introduced into a second heat exchanger, and cooled by indirect heat exchange with a refrigerant. The nitrogen gas thus cooled is compressed in a low-temperature nitrogen compressor and supplied through a heater to an external plant for consumption. LNG is introduced into a first heat exchanger as a cold source. In the first heat exchanger, LNG cools and liquefies the refrigerant by indirect heat exchange. The liquefied refrigerant is sent to the second heat exchanger. The refrigerant is vaporized by indirect heat exchange with the nitrogen gas in the second heat exchanger. The vaporized refrigerant is returned to the first heat exchanger.

12 Claims, 4 Drawing Sheets

APPARATUS FOR AIR SEPARATION

This application claims priority under 35 U.S.C. §§ 119 and/or 365 to 11-145962 filed in Japan on May 26, 1999; the entire content of which is hereby incorporated by reference.

CROSS-REFERENCE TO RELATED APPLICATIONS

This application is based upon and claims the benefit of priority from the prior Japanese Patent Application No. 11-145962, filed May 26, 1999, the entire contents of which are incorporated herein by reference.

BACKGROUND OF THE INVENTION

The present invention relates to an apparatus for air separation utilizing liquefied natural gas (LNG) as a cold source. Specifically, the invention relates to an air separation apparatus suitable for supplying high-pressure nitrogen gas and oxygen gas to an integrated gasifier combined cycle plant.

Since LNG is consumed in a gas phase in a final stage, various kinds of processes have been proposed wherein cold generated during gasification of LNG is effectively used. For example, there is known a process utilizing LNG as a cold source in an air separation apparatus for producing nitrogen and oxygen by cryogenic separation.

Jpn. Pat. Appln. KOKOKU Publication No. 49-45054, for instance, discloses a process in which cold is utilized for directly cooling feed air. Jpn. Pat. Appln. KOKOKU Publication No. 52-41224 discloses a process wherein cold of LNG is utilized for cooling and liquefying nitrogen, which is restored to room temperature, compressed and recycled. Further, Jpn. Pat. Appln. KOKOKU Publication No. 46-16081 describes a process wherein cold of LNG is utilized directly for cooling both nitrogen, which is to be recycled, and feed air.

In a case where a nitrogen cycle is adopted in order to supply cold needed in an air separation process, cold is produced by compression, liquefaction and expansion of nitrogen. In this case, it is known that less power is consumed when nitrogen gas at a low temperature is compressed, than when nitrogen gas at room temperature is compressed. For this reason, of the above publications, Jpn. Pat. Appln. KOKOKU Publication No. 46-16081 adopts a process wherein nitrogen gas is cooled by LNG (or a low-temperature gas separated in an air separation apparatus) and then compressed, thereby reducing power cost. In the process described in this publication, however, nitrogen is recovered in a liquid phase by compression and liquefaction of separated nitrogen gas.

In an integrated gasifier combined cycle plant to which special attention has recently been paid, a large amount of high-pressure nitrogen gas and oxygen gas is consumed. On the other hand, the pressure of nitrogen gas or oxygen gas produced by a conventional air separation apparatus was insufficient. Thus, in general, such gases were compressed using a compressor at room temperature, and then supplied to the plant. Therefore, power cost was high for the operation of the compressor. Under the circumstances, an improvement was desired for reducing power cost in an integrated gasifier combined cycle plant.

On the other hand, cold of LNG is utilized in conventional air separation apparatuses in order to supply cold needed for air separation or to supply separated products to the outside in a liquid phase. However, there was no idea that cold of LNG is utilized for the purpose of increasing the pressure of a product gas.

BRIEF SUMMARY OF THE INVENTION

The object of the present invention is to provide an air separation apparatus for producing, at low power cost, high-pressure nitrogen gas and oxygen gas used in, for example, an integrated gasifier combined cycle plant, by utilizing cold of liquefied natural gas.

In order to achieve the object described above, the present invention provides an apparatus comprises: a cryogenic separation unit for receiving pre-purified feed air and separating the same into nitrogen gas and oxygen gas; a first heat exchanger for receiving liquefied natural gas as a cold source and for cooling and liquefying a refrigerant by indirect heat exchange with the liquefied natural gas; a second heat exchanger; a refrigerant supply line for supplying the refrigerant liquefied in the first heat exchanger to the second heat exchanger; a refrigerant return line for returning the refrigerant vaporised in the second heat exchanger to the first heat exchanger; a first nitrogen gas line for sending at least part of the nitrogen gas separated in the cryogenic separation unit to the second heat exchanger; a second nitrogen gas line for supplying the nitrogen gas cooled within the second heat exchanger to the outside; and a low-temperature nitrogen compressor provided on the second nitrogen line for compressing the nitrogen gas and supplying the compressed nitrogen gas as high-pressure product gas to the outside.

The phrase "high-pressure product gas" in this context means a product gas having a higher pressure than that obtained in a conventional air separation process. For example, a product gas with a pressure of 10 bar (abs.) or more is referred to.

According to the air separation apparatus of the present invention, nitrogen gas separated in the cryogenic separation unit is introduced into the second heat exchanger, cooled by indirect heat exchange with the refrigerant (cooled by LNG), and then compressed by the low-temperature nitrogen compressor. In this manner, since the separated nitrogen gas is compressed at a low temperature, power cost for compressing the nitrogen gas can be reduced.

In addition, the compressed nitrogen gas is heated in order to supply the product nitrogen gas to an external plant for consumption, if necessary. No extra thermal energy is required for heating the compressed nitrogen gas (for example, seawater can be used). Thus the heating thereof does not cause an increase in power cost.

The oxygen gas separated in the cryogenic separation unit can also be compressed at a low temperature, using a process similar to the above. Thereby, power cost for compressing the oxygen gas can be saved.

Preferably, the air separation apparatus of the present invention further comprises: a first feed air line for sending the pre-purified feed air to the second heat exchanger; a second feed air line for sending the feed air cooled within the second heat exchanger to the cryogenic separation unit; and a low-temperature air compressor provided on the second feed air line for compressing the feed air.

As described above, the feed air is cooled in the second heat exchanger and then compressed in the low-temperature air compressor, thereby reducing the power cost for compressing the feed air.

According to the air separation apparatus of the present invention, the refrigerant is circulated between the first heat exchanger and the second heat exchanger, and the nitrogen gas is cooled by latent heat of this refrigerant. Thereby, the nitrogen gas can be cooled with efficiency. In such a case, a thermal medium other than product nitrogen gas or feed gas can be used as a refrigerant. Therefore, safety is ensured when LNG is mixed in the thermal medium by adopting a chemically inert substance as a thermal medium. As a result, high-pressure nitrogen gas and oxygen gas used in, for example, an integrated gasifier combined cycle plant can be produced at low power cost, by utilizing cold of liquefied natural gas.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the drawings.

[Embodiment 1]

Figure 1:
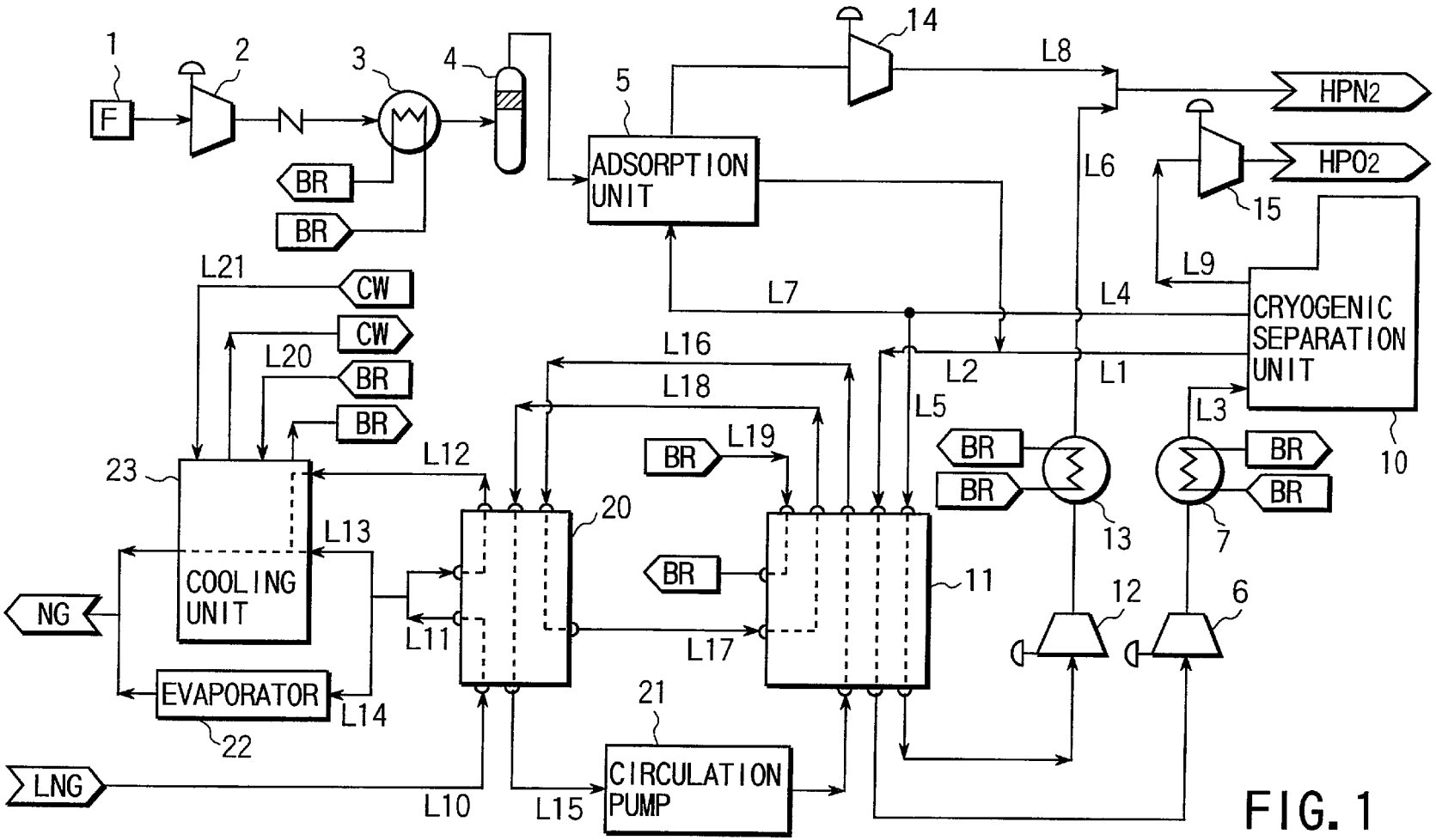
FIG. 1 is a block diagram schematically showing a first embodiment of an air separation apparatus according to the present invention.

FIG. 1 is a block diagram schematically showing a first embodiment of an air separation apparatus of the present invention.

The air separation apparatus comprises a cryogenic separation unit 10 for separating air at a low temperature. In a pre-purifying step, constituents hard to be removed in the cryogenic separation unit 10, or impurities such as fine particles are removed. Specifically, dust in feed air is removed through a filter 1. The feed air is then compressed in a feed air compressor 2, and cooled by brine (e.g. seawater) in a cooler 3. Water-soluble constituents of the feed air are removed in a water separator 4. Then, the feed air is introduced into an adsorber 5 having a molecular sieve, and water and carbon dioxide of the air is removed. A major part of the feed air (between 60 and 80%) is introduced via line L1 into the cryogenic separation unit 10 at 4 bar (gage).

The cryogenic separation unit 10 comprises, in general, one or more distillation columns, heat exchangers, and their associated equipments. Any one of known cryogenic separation units can be adopted in the present invention. Descriptions of the specific structure of the cryogenic separation unit 10 and the process therein will be omitted because they have little relation to the present invention.

The present invention, however, has a purpose of supplying a product gas (nitrogen gas and oxygen gas) at high pressure to an external plant for consumption. Therefore, of the known cryogenic separation units, a cryogenic separation unit based on a liquid-oxygen pump-up system can realize the advantages of the present invention remarkably. In the cryogenic separation unit based on this system, a part of feed air (e.g. of 30 bar (abs.)) is used to vaporize an oxygen product. The feed air is fractionated on the downstream side of the adsorber 5. The air is then introduced via line L2 into a second heat exchanger 11 and cooled (e.g. to −147° C). Next, the feed air is compressed in a low-temperature air compressor 6 (e.g. to 30 bar (gage)), and heated by brine (e.g. seawater) in a heater 7. The air is then introduced via line L3 into the cryogenic separation unit 10.

The product nitrogen gas is extracted via line L4 from the cryogenic separation unit 10. A major part of the product nitrogen gas is introduced via line L5 into the second heat exchanger 11, and cooled by indirect heat exchange with a refrigerant (e.g. to −147° C.). The cooled product nitrogen gas is compressed in a low-temperature nitrogen compressor 12 (e.g. to 30 bar (abs.)), and then heated by brine (e.g. seawater) in a heater 13. The product nitrogen gas is then introduced via line L6 into an external plant for consumption. The residual product nitrogen gas is introduced, via line L7, into the adsorber 5 and used as a regenerative gas. Then, the residual product nitrogen gas is compressed in a nitrogen compressor 14, fed through line L8, combined with the product nitrogen gas from line L6, and supplied to the external plant for consumption.

On the other hand, the product oxygen gas is extracted via line L9 from the cryogenic separation unit 10. Then the product oxygen gas is compressed by an oxygen compressor 15 and supplied to the plant for consumption at high pressure (e.g. 80 bar(abs.)).

In the air separation apparatus according to the present invention, liquefied natural gas is utilized as a cold source. Therefore, as shown in FIG. 1, a circulating circuit is provided for circulating a refrigerant between the first heat exchanger 20 and the second heat exchanger 11.

The liquefied natural gas is introduced into the first heat exchanger 20 as a cold source. The refrigerant is cooled by indirect heat exchange with the liquefied natural gas in the first heat exchanger 20, and is liquefied. The refrigerant thus liquefied is sent to the second heat exchanger 11. The refrigerant is used in the second heat exchanger 11 for cooling the product nitrogen gas and the feed air, and is vaporised. The vaporised refrigerant is returned to the first heat exchanger 20 and cooled again.

It is preferable to use an inert gas (e.g. nitrogen or a noble gas such as argon) as a refrigerant of the circulating circuit so that safety can be ensured even if the liquefied natural gas is mixed in. In addition, the rise in temperature within the pump 21 is slight.

Specifically, the liquefied natural gas is introduced via line L10 into the first heat exchanger 20 at high pressure (e.g. 40 bar(abs.)) and a low temperature (e.g. −155° C.). The liquefied natural gas is vaporised by indirect heat exchange with the refrigerant (introduced via line L16 and line L18) within the first heat exchanger 20. The natural gas thus vaporised is extracted via line L12 or L11 at different temperatures. The natural gas extracted via line L12 is supplied to a cooler 23. The natural gas (mixture of vapor and liquid) extracted via line L11 is supplied via line L13 to the cooler 23, and is supplied via line L14 to a warm water evaporator 22. The natural gas (NG), after cold is further recovered in the cooler 23 and the warm water evaporator 23, is supplied to the external plant for consumption. Cold water (CW) is introduced via line L21 into the warm water evaporator 23, and brine (BR) for cooling is introduced via line L20 into the warm water evaporator 23. The cold water (CW) cooled in the cooler 23 and the brine (BR) for cooling is used for cooling in the air separation apparatus itself and in other plants.

On the other hand, the refrigerant is circulated via line L18 to the first heat exchanger 20. The refrigerant is cooled by indirect heat exchange with LNG within the first heat exchanger 20, and is liquefied. Then the refrigerant is extracted via line L15 at high pressure (e.g. 45 bar (abs.)) and a low temperature (e.g. −150° C.), and sent to the second heat exchanger 11 by a pump 21. The refrigerant is vaporised by indirect heat exchange between the product nitrogen gas (introduced via L5) and part of the feed air (introduced via L2). The refrigerant thus vaporised is extracted via line L16, and introduced again into the first heat exchanger 20 and cooled. The cooled refrigerant (e.g. −130° C.) is sent again via line L17 to the second heat exchanger 11, and used for cooling the product nitrogen gas and feed air. The refrigerant is extracted via line L18 from the second heat exchanger and returned to the first heat exchanger 20.

In this way, one circulation cycle is constituted by circulating the refrigerant twice between the first heat exchanger 20 and the second heat exchanger 11. The purpose for constituting the circulation cycle is to effectively use cold of the liquefied natural gas.

[Embodiment 2]

Figure 2:
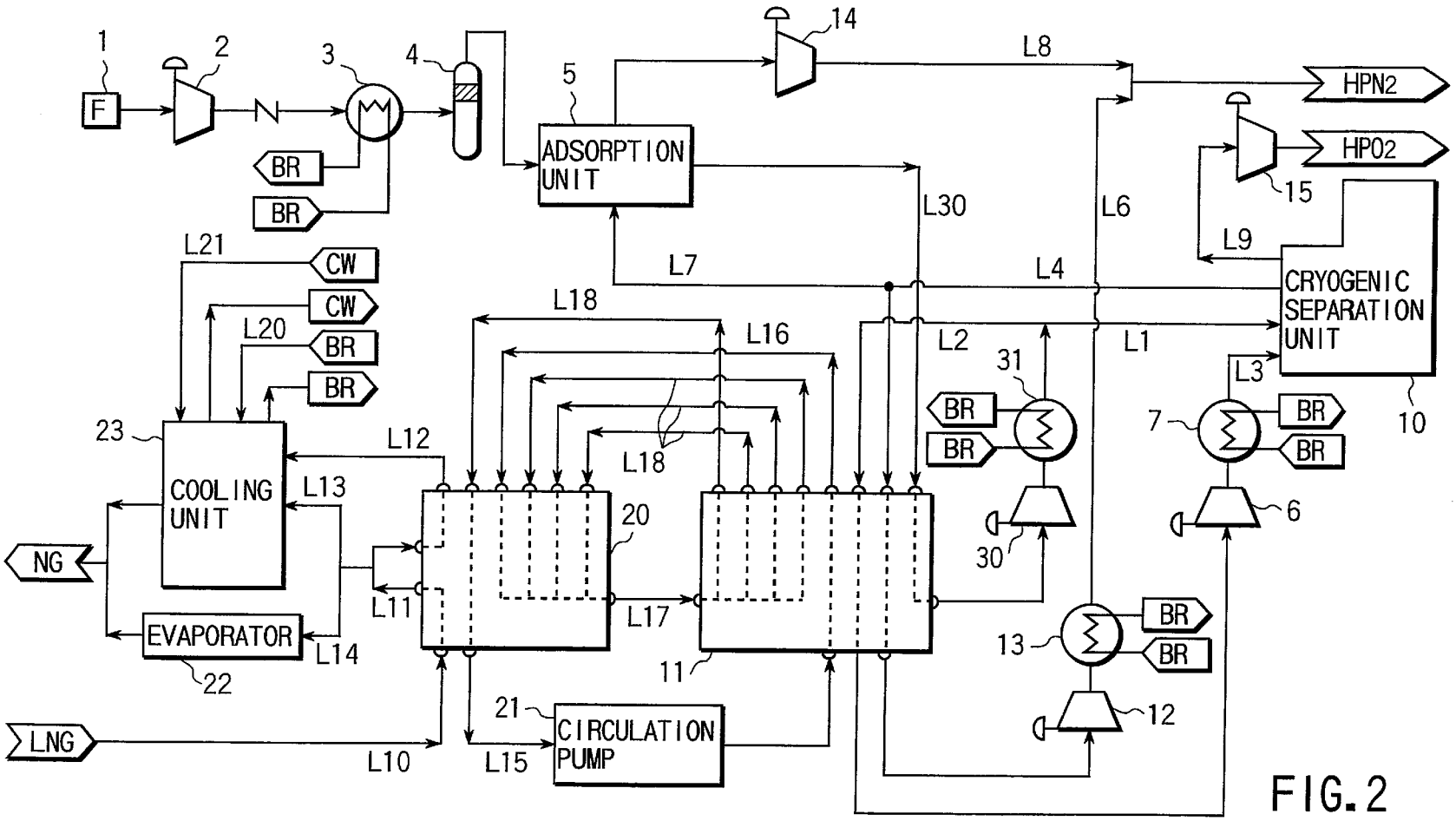
FIG. 2 is a block diagram schematically showing a second embodiment of the air separation apparatus according to the present invention.

FIG. 2 is a block diagram schematically showing a second embodiment of the air separation apparatus of the present invention.

In the first embodiment, the product nitrogen gas and the feed air for vaporizing the oxygen product is compressed at low temperatures. It is preferable, however, to compress, in addition, the feed air to be distilled at a low temperature. Therefore, in the second embodiment, a supply line for feed air is constituted as described below. With respect to this embodiment, only the portions which are different from the first embodiment (FIG. 1) will be described.

The feed air extracted from the adsorber 5 is introduced via line L30 into the second heat exchanger 11, and is cooled (e.g. to −120° C.). Then the feed air is compressed in the low-temperature air compressor 30 (e.g. to 30 bar (gage)), and heated by brine (e.g. seawater) in a heater 31. After that, most of the feed air is introduced via line L1 into the cryogenic separation unit 10. The residual feed air is introduced again via line L2 into the second heat exchanger 11. As in the first embodiment, the residual feed air is then introduced into the cryogenic separation unit 10 through the low-temperature air compressor 6 and the heater 7, and is used for vaporizing the oxygen product.

In this embodiment, one circulation cycle is constituted by circulating the refrigerant five times between the first heat exchanger 20 and the second heat exchanger 11, as shown in FIG. 2. The purpose for constituting the circulation cycle is to enhance the efficiency of use of the cold of liquefied natural gas. Line L17 introduces the refrigerant into the second heat exchanger 11 at −130° C., for example.

Table 1 shows a calculation results of power consumption for the purpose of comparison between the air separation apparatus of the present invention and the conventional one (which performs the compression of the product nitrogen gas at room temperature). In Table 1, power consumption is expressed by relative values, assuming that the total power consumption in the conventional air separation is 100 (%).

TABLE 1

Calculation result of power consumption (relative values)

| | Prior art | Embodiment-1 | Embodiment-2 |
|---|---|---|---|
| Feed air (L1) | 127,000 $Nm^3/h$ | 13 bar (abs.) | |
| Feed air (L3) | 56,100 $Nm^3/h$ | 30 bar (abs.) | |
| $O_2$ gas (L9) | 40,000 $Nm^3/h$ | 14 bar (abs.) | |
| $N_2$ gas (L4) | 142,800 $Nm^3/h$ | 4 bar (abs.) | |
| High pressure $O_2$ gas | 40,000 $Nm^3/h$ | 80 bar (abs.) | |
| High pressure $N_2$ gas | 142,800 $Nm^3/h$ | 30 bar (abs.) | |
| Feed air compressor (2) | 54.5 | 54.5 | 38.2 |
| Low temperature air compressor (30) | — | — | 9.7 |
| Feed air compressor | 5.5 | — | — |
| Low temperature air compressor (6) | — | 2.9 | 2.9 |
| $O_2$ compressor (15) | 8.6 | 8.6 | 8.6 |
| $N_2$ compressor (14) | 31.4 | 6.3 | 7.3 |
| Low temperature $N_2$ compressor (12) | — | 16.0 | 15.3 |
| Total | 100 | 88.3 | 82.0 |

[Embodiment 3]

Figure 3:
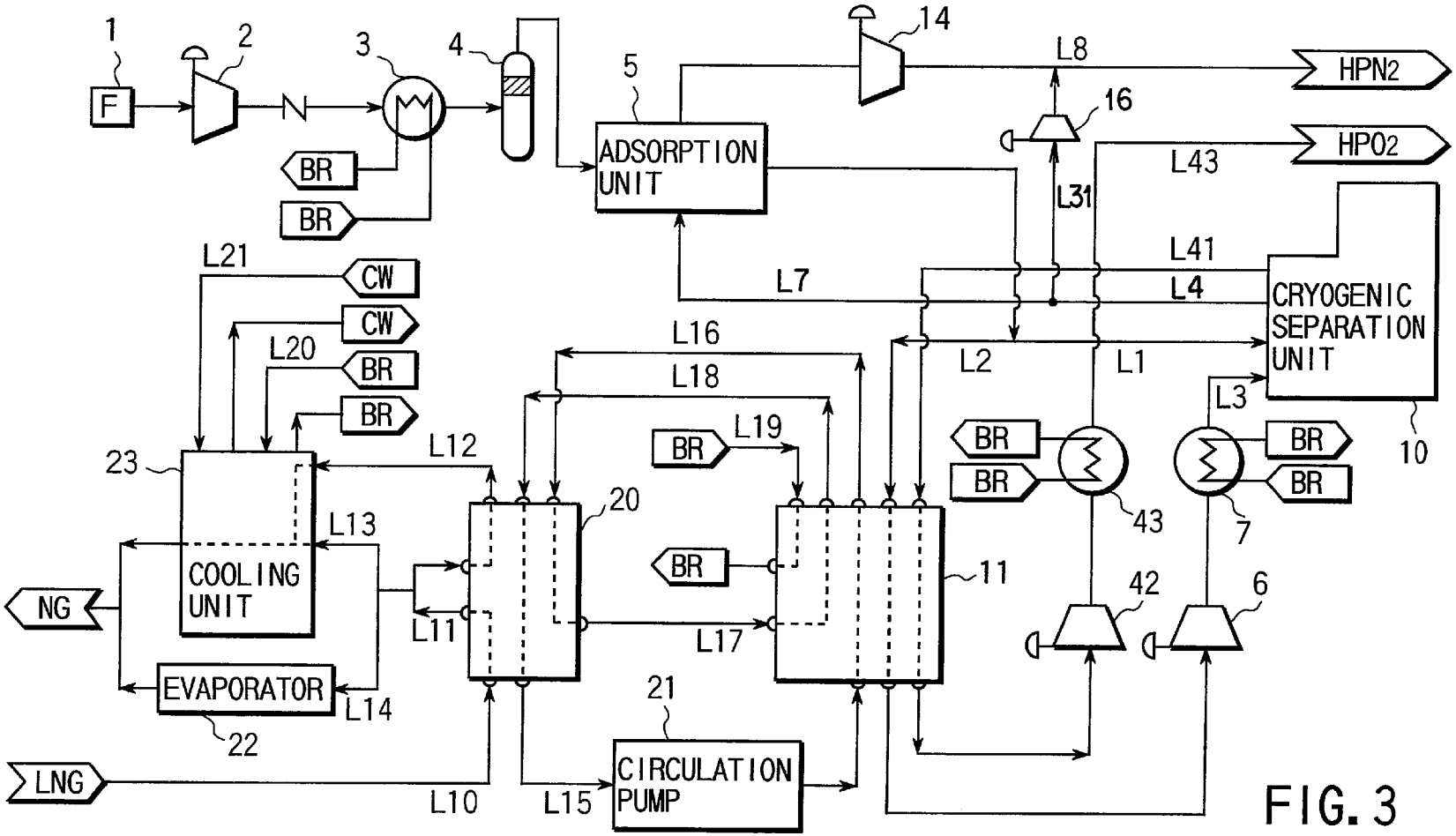
FIG. 3 is a block diagram schematically showing a third embodiment of the air separation apparatus according to the present invention.

In the preceding embodiments, the product nitrogen gas separated in the cryogenic separation unit 10 is compressed at a low temperature. The product oxygen gas separated in the cryogenic separation unit 10 may also be compressed at a low temperature in a similar manner. FIG. 3 is a block diagram schematically showing a third embodiment of the air separation apparatus of the present invention.

The product oxygen gas extracted from the cryogenic separation unit 10 is introduced via line L41 into the second heat exchanger 11, and is cooled. The cooled product oxygen gas is compressed in a low-temperature oxygen compressor 42, heated in a heater 43, and then supplied via line L43 to the external plant for consumption.

The product nitrogen gas extracted from the cryogenic separation unit 10 is introduced via line L4 and L31 into the nitrogen compressor 16, and supplied via line L8 to the external plant for consumption. A part of the product nitrogen gas is introduced via line L4 and L7 into the adsorber 5, and used as regenerative gas. Then, the gas discharged from the adsorber 5 is compressed in the nitrogen compressor 14, and merged into the flow of the product nitrogen gas in the line L8.

The other structure in the third embodiment is the same as that shown in FIG. 1.

[Embodiment 4]

Figure 4:
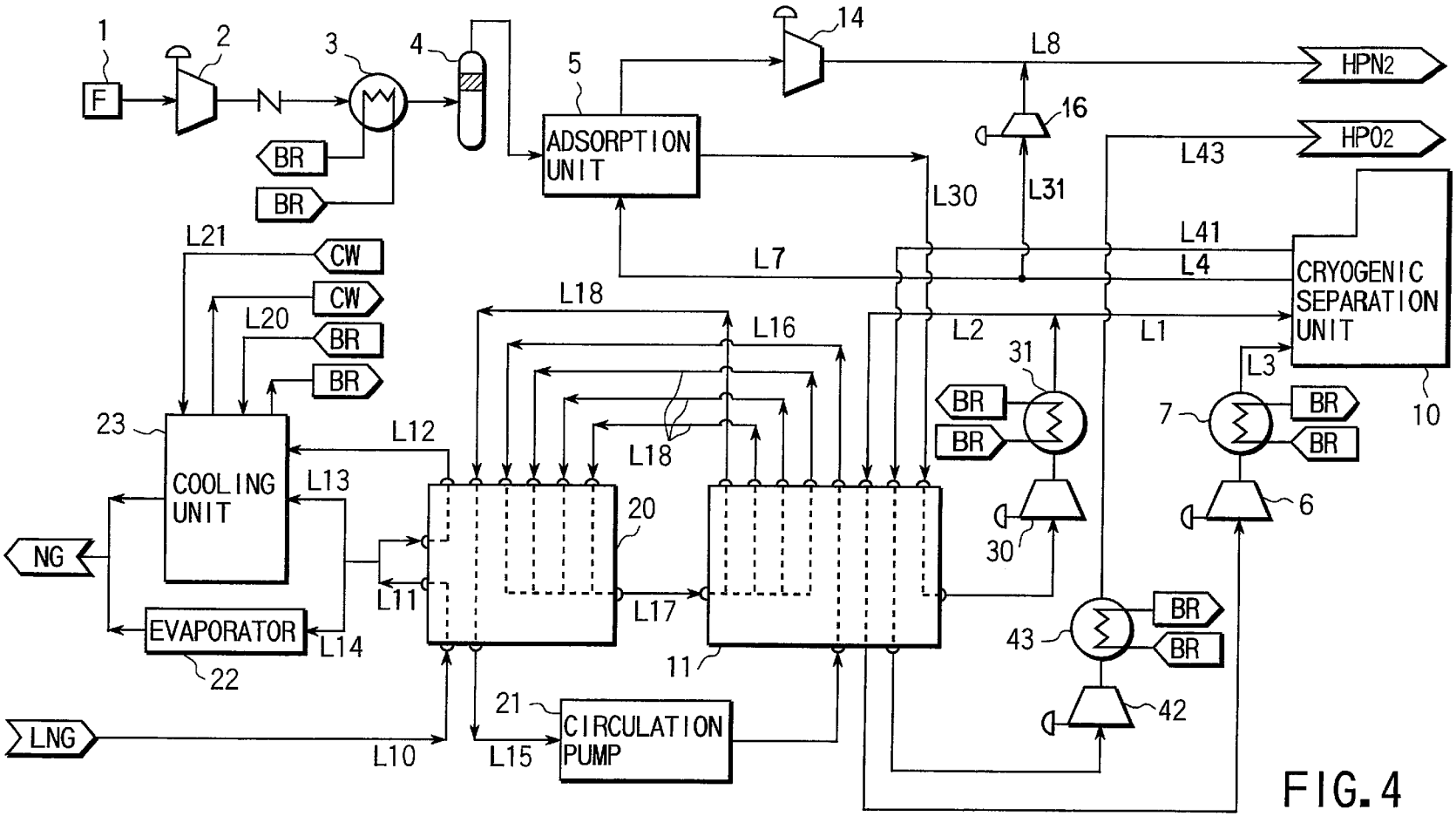
FIG. 4 is a block diagram schematically showing a fourth embodiment of the air separation apparatus according to the present invention.

FIG. 4 is a block diagram schematically showing a fourth embodiment of the air separation apparatus of the present invention.

In the embodiment shown in FIG. 3, the product oxygen gas and the feed air for vaporizing the oxygen product is compressed at low temperatures. In the fourth embodiment, the feed air to be distilled is also compressed at a low temperature.

The feed air coming out of the adsorber 5 is introduced via line L30 into the second heat exchanger 11, and is cooled. Then, the feed air is compressed in the low-temperature air compressor 30, and heated by brine (e.g. seawater) in the heater 31. Thereafter, most of the feed air is introduced via line L1 into the cryogenic separation unit 10. The residual feed air is introduced again via line L2 into the cryogenic separation unit 10. As in the third embodiment, the residual feed air is then introduced into the cryogenic separation unit 10 through the low-temperature air compressor 6 and the heater 7, and is used for vaporizing the oxygen product.

The other structure in the fourth embodiment is the same as that shown in FIG. 3 or 2.

The numerical values of e.g. pressure and temperature used in the above description are mere examples of operational conditions, and do not limit the scope of the present invention.

In the above embodiments, one circulation cycle is constituted by circulating the refrigerant twice (FIG. 1) or five times (FIG. 2) between the first heat exchanger 20 and the second heat exchanger 11 in order to use cold of LNG effectively. However, the number of circulations is set to be a proper value according to various conditions, such as the amount of LNG, a required pressure of product nitrogen gas or product oxygen gas.

The air separation apparatus is suitable, in particular, for supplying high-pressure nitrogen gas and oxygen gas to an integrated gasifier combined cycle plant. Besides, the apparatus can effectively be used in various kinds of plants, where high-pressure nitrogen gas or oxygen gas is used, such as a steelmaking plant.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus for air separation comprising:

a cryogenic separation unit for receiving pre-purified feed air and separating the same into nitrogen gas and oxygen gas;

a first heat exchanger for receiving liquefied natural gas as a cold source and for cooling and liquefying a refrigerant by indirect heat exchange with said liquefied natural gas;

a second heat exchanger;

a refrigerant supply line for supplying said refrigerant liquefied in the first heat exchanger to the second heat exchanger;

a refrigerant return line for returning said refrigerant vaporised in the second heat exchanger to the first heat exchanger;

a first nitrogen gas line for sending at least part of the nitrogen gas separated in said cryogenic separation unit to the second heat exchanger;

a second nitrogen gas line for supplying said nitrogen gas cooled within the second heat exchanger to the outside; and a low-temperature nitrogen compressor provided on the second nitrogen line for compressing said nitrogen gas and supplying the compressed nitrogen gas as high-pressure product gas to the outside.

2. An apparatus for air separation according to claim 1, further comprising:

a first feed air line for sending said pre-purified feed air to the second heat exchanger;

a second feed air line for sending said feed air cooled within the second heat exchanger to said cryogenic separation unit; and a low-temperature air compressor provided on the second feed air line for compressing said feed air.

3. An apparatus for air separation according to claim 1, wherein the compression of said nitrogen gas takes place at below −100° C.

4. An apparatus for air separation according to claim 1, wherein the refrigerant is nitrogen or argon.

5. An apparatus for air separation according to claim 1, further comprising:

means for warming said compressed nitrogen gas, provided on the second nitrogen line at the downstream of the low-temperature nitrogen compressor.

6. An apparatus for air separation according to claim 1, wherein only part of the liquefied natural gas is evaporated in the first heat exchanger.

7. An apparatus for air separation comprising:

a cryogenic separation unit for receiving pre-purified feed air and separating the same into nitrogen gas and oxygen gas;

a first heat exchanger for receiving liquefied natural gas as a cold source and for cooling and liquefying a refrigerant by indirect heat exchange with said liquefied natural gas;

a second heat exchanger;

a refrigerant supply line for supplying said refrigerant liquefied in the first heat exchanger to the second heat exchanger;

a refrigerant return line for returning said refrigerant vaporised in the second heat exchanger to the first heat exchanger;

a first oxygen gas line for sending at least part of the oxygen gas separated in said cryogenic separation unit to the second heat exchanger;

a second oxygen gas line for supplying said oxygen gas cooled within the second heat exchanger to the outside; and a low-temperature oxygen compressor provided on the second oxygen line for compressing said oxygen gas and supplying the compressed oxygen gas as high-pressure product gas to the outside.

8. An apparatus for air separation according to claim 3, further comprising:

a first feed air line for sending said pre-purified feed air to the second heat exchanger;

a second feed air line for sending said feed air cooled within the second heat exchanger to said cryogenic separation unit; and a low-temperature air compressor provided on the second feed air line for compressing said feed air.

9. An apparatus for air separation according to claim 7, wherein the compression of said oxygen gas takes place at below −100° C.

10. An apparatus for air separation according to claim 7, wherein the refrigerant is nitrogen or argon.

11. An apparatus for air separation according to claim 7, further comprising:

means for warming said compressed oxygen gas, provided on the second oxygen line at the downstream of the low-temperature oxygen compressor.

12. An apparatus for air separation according to claim 7, wherein only part of the liquefied natural gas is evaporated in the first heat exchanger.

* * * * *